US006508017B1

(12) United States Patent
DeBarro et al.

(10) Patent No.: US 6,508,017 B1
(45) Date of Patent: Jan. 21, 2003

(54) CUSHIONING DEVICE FOR FOOTWEAR

(75) Inventors: Robert DeBarro, Western Australia (AU); Brian John Piggott, Jakarta Barat (ID)

(73) Assignee: Footwear Industries Pty Ltd (AU)

( * ) Notice: Subject to any disclaimer, the term of this patent is extended or adjusted under 35 U.S.C. 154(b) by 0 days.

(21) Appl. No.: 09/763,322

(22) PCT Filed: Aug. 20, 1999

(86) PCT No.: PCT/AU99/00671

§ 371 (c)(1),
(2), (4) Date: Feb. 20, 2001

(87) PCT Pub. No.: WO00/10416

PCT Pub. Date: Mar. 2, 2000

(30) Foreign Application Priority Data

Aug. 20, 1998 (AU) ..... PP5364

(51) Int. Cl.[7] ..... A43B 13/18

(52) U.S. Cl. ..... 36/28; 36/30 R; 36/31; 36/44

(58) Field of Search ..... 36/28, 30 R, 31, 36/44

(56) References Cited

U.S. PATENT DOCUMENTS 2,379,366 A * 6/1945 Lumbard
4,364,188 A * 12/1982 Turner et al.
4,463,505 A * 8/1984 Duclos
4,794,707 A * 1/1989 Franklin et al.
5,044,096 A * 9/1991 Polegato
5,092,060 A * 3/1992 Frachey et al.
5,146,698 A 9/1992 Tilles et al. ..... 36/44
5,311,677 A * 5/1994 Mann et al.
5,435,078 A 7/1995 Pyle ..... 36/30 R
6,038,790 A * 3/2000 Pyle et al.
6,050,001 A * 4/2000 Ditrtrich

FOREIGN PATENT DOCUMENTS

| | | |
|---|---|---|
| AU | A-74158/96 | 6/1997 |
| EP | 0 399 332 A1 | 11/1990 |
| EP | 0 838 170 A2 | 4/1998 |
| GB | 2 300 558 A | 11/1996 |
| JP | 2-234701 A | 9/1990 |
| JP | 2-234702 A | 9/1990 |
| JP | 2-234703 A | 9/1990 |
| WO | WO 93/02581 | 2/1993 |

OTHER PUBLICATIONS

Optimising Comfort in Footwear, Sharon Tailby and Darren Thompson, pp. 17–19, SATRA Bulletin, Feb. 1998.
Biomechanics of the Foot, pp. 3 & 5.

* cited by examiner

*Primary Examiner*—Ted Kavanaugh
(74) *Attorney, Agent, or Firm*—Marger Johnson & McCollom, P.C.

(57) ABSTRACT

A cushioning device for footwear that provides flexibility in the forepart area. The device having an insole with perforations in the forepart region and a first pad underlying the region. The device having a cutout in the heel region with an insert provided in the cutout.

28 Claims, 2 Drawing Sheets

CUSHIONING DEVICE FOR FOOTWEAR

This application is a 37.1 of PCT/AU99/00671 filed Aug. 20, 1999.

FIELD OF THE INVENTION

The present invention relates to a cushioning device for footwear, footwear incorporating such a cushioning device, a method of manufacture of a cushioning device and a method of manufacture of footwear incorporating such a cushioning device.

A pressure mapping study of the pressures that occur underfoot whilst a wearer walks on a treadmill has indicated that there are large areas of high pressure under the heel and under the forepart of the foot. These areas also contain points of peak pressure to which the wearer's foot is subjected during walking and running due to impact shock and stress.

BACKGROUND ART

Inserts for footwear which are intended to improve the wearer's comfort are known. However, these inserts are merely inserted into the footwear. Such inserts are not part of the manufactured footwear item but are added later by the wearer. Other prior art devices provide cushioning systems within the footwear itself, e.g. in the outsole.

Such prior art devices do not, however, specifically target the areas of the foot that are subject to high and peak pressure to provide effective cushioning to the foot from a wide range of impacts.

The present invention is directed toward a cushioning device and footwear which provides cushioning and energy impact absorption to the parts of the foot most susceptible to high and peak pressures due to impact shock and stress forces.

In accordance with one aspect of the present invention there is provided a cushioning device for footwear comprising an insole;

a region at the forepart of said insole having perforations such that said region at the forepart of said insole has greater flexibility than the remainder of said insole, to enable said region at the forepart of said insole to conform in response to compression imparted to said insole;

first pad means on the under-face of said insole underlying said region at the forepart of said insole, said first pad is of substantially the same shape and size as said region at the forepart of said insole;

a cutout opening in the heel region of said insole;

an insert provided in said cutout opening;

second pad on the under-face of said insole underlying said insert; and said first and second pad and said insert being substantially shock absorbing and resilient.

In accordance with a second aspect of the present invention there is provided an item of footwear comprising a footwear upper, a cushioning device as hereinbefore described, and an outsole attached to said footwear upper, wherein said outsole covers said first and second pad means and said under-face of said insole.

In accordance with a third aspect of the present invention there is provided a method of making a cushioning device for footwear comprising:

providing an insole;

perforating a region at the forepart of said insole such that said region at the forepart of said insole has greater flexibility than the remainder of said insole to enable said region at the forepart of said insole to conform in response to compression imparted to said insole;

underlying said region at the forepart of said insole with a first pad on the under-face of said insole said first pad being substantially the same shape and size as said region at the forepart of said insole;

cutting out an opening in the heel region of said insole;

positioning an insert in said opening;

underlying said insert with a second pad on the under-face of said insole; and said first and second pad and said insert being substantially shock absorbent and resilient.

In accordance with a fourth aspect of the present invention there is provided a method of making an item of footwear comprising providing a footwear upper, providing a cushioning device as hereinbefore described, covering said first and second pad means and said under-face of said insole with an outsole, and attaching said outsole to said footwear upper.

Preferably, said region at the forepart of said insole substantially coincides with the first to fifth metatarsal heads and big toe of a person's foot.

Preferably, cover means is provided over said first pad means at said forepart of said insole.

Preferably, said first pad means is attached to said insole.

Preferably, said second pad means is attached to said insole and said insert means.

Preferably, shank support means is provided at substantially the mid region of said insole intermediate said forepart and said heel region thereof.

Preferably, said shank support means does not overlap with said first or second pad means.

Preferably, said shank support means is substantially in the form of a strip of supportive material having greater rigidity than said insole.

Preferably, said shank support means is provided on said under-face of said insole.

BRIEF DESCRIPTION OF THE DRAWINGS

The present invention will now be described, by way of example, with reference to the accompanying drawings, in which.

BEST MODE(S) FOR CARRYING OUT THE INVENTION

Figure 1:
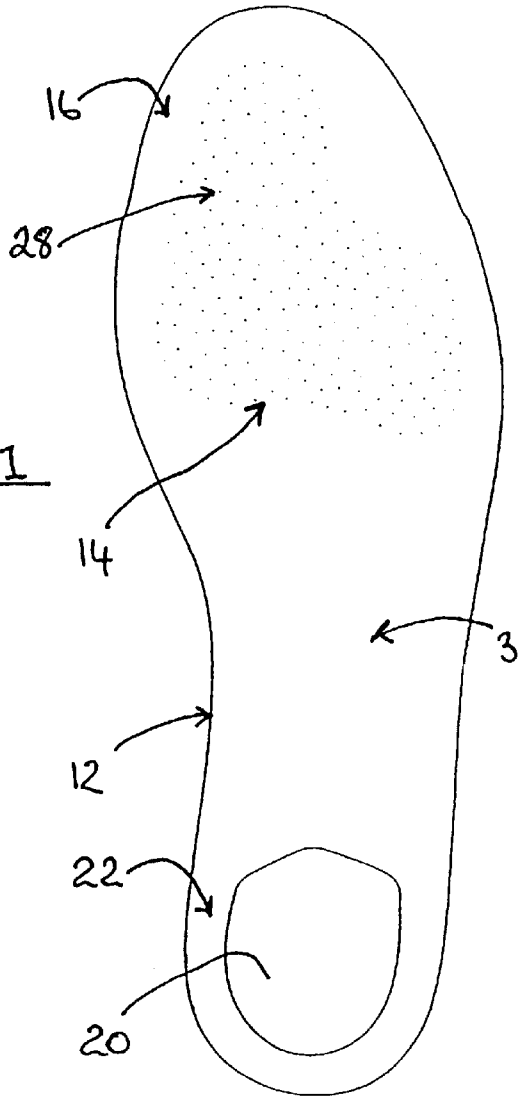
FIG. 1 is a plan view of the insole of an embodiment of a cushioning device in accordance with a first aspect of the present invention.
Figure 2:
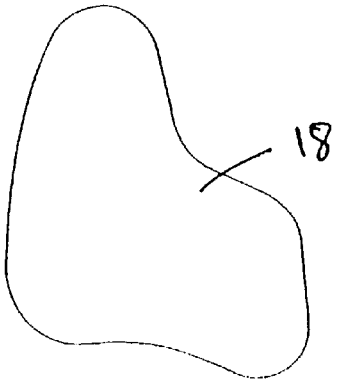
FIG. 2 is a plan view of a pad to underlie the forepart region of the insole shown in FIG. 1.
Figure 5:
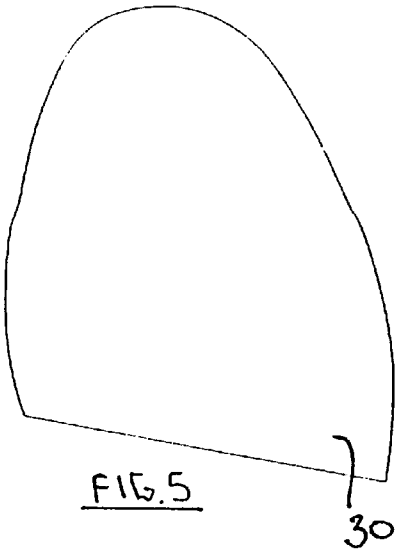
FIG. 5 is a cover to cover the first pad at the forepart of the insole shown in FIG. 1.
Figure 3:
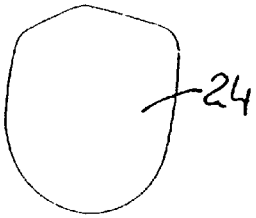
FIG. 3 is a plan view of an insert for the cutout opening in the heel region of the insole shown in FIG. 1.
Figure 4:
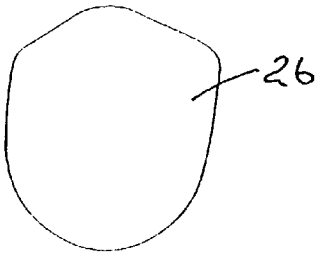
FIG. 4 is a second pad to underlie the insert in the heel region of the insole shown in FIG. 1.

In FIGS. 6–9 there is shown an item of footwear 100 incorporating a cushioning device 10 for footwear.

The parts of the cushioning device 10, except the shank support 32, are shown separately in FIGS. 1–5. Thus, FIGS. 1–5 may be considered as an exploded view of the cushioning device 10 incorporated in the footwear 100. The cushioning device 10 shown in FIGS. 1–5 is for a right foot shoe.

For convenience of description, the cushioning device 10 of the present invention will be described with reference to FIGS. 1–5 and also FIGS. 6–9.

The cushioning device 10 comprises an insole 12, a region 14 at the forepart 16 of the insole 12 which has greater flexibility than the remainder of the insole 12, a first pad 18 on the under-face 34 of the insole 12 underlying the region 14 of the insole 12, a cutout opening 20 in the heel region 22 of the insole 12, an insert 24 provided in the cut out opening 20 and a second pad 26 on the under-face 34 of the insole 12 underlying the insert 24. The first and second pads 18 and 26 and the insert 24 are substantially shock absorbing and resilient.

The region 14 that has greater flexibility than the remainder of the insole 12 substantially coincides with the first to fifth metatarsal heads and big toe of a person's foot.

A cover 30 may be provided over the first pad 18.

The cover 30 assists in retaining the first pad 18 in place during construction of an item of footwear 100 incorporating the cushioning device 10. The cover 30 may be adhered to the first pad 18 and the insole 12, for example, with a contact adhesive.

In the embodiment shown in the drawings, the forepart 16 of the insole 12 is provided with perforations 28. The perforations 28 thus form the region 14 at the forepart 16 of the insole 12 that has greater flexibility than the remainder of the insole 12.

The perforations 28 may be of any suitable dimension which provides increased flexibility at the region 14 of the forepart 16 of the insole 12. For example, the perforations may be approximately 1 mm–2 mm in diameter.

The first pad 18 is attached to the insole 12. This may be done, for example, with a pressure sensitive adhesive.

The second pad 26 is attached to the insert 24 in the heel region 22 of the insole 12 and to the portion of the insole 12 surrounding the insert 24. Thus, the second pad 26 is larger than the insert 24 such that it overlaps onto the insole 12. This can be best seen in FIGS. 6 and 9. The second pad 26 may be attached to the insert 24 and insole 12, for example, by a hot-melt adhesive. The surfaces of the insert 24 and the second pad 26 may be scoured to enhance grip of the adhesive thereto.

A shank support 32 may be provided at the mid region 33 of the insole 12 intermediate the forepart 16 and the heel region 22.

The shank support 32 is provided such that it does not overlap with the first or second pads 18 and 24.

The shank support 32 may be provided as a strip of supportive material that is more rigid than the material of the insole 12. For example, the shank support 32 may be made from polycarbonate, steel or nylon.

The shank support 32 may be attached to the insole 12 by adhesive, riveting or other suitable means.

The insole 12 has first and second faces 34 and 36, respectively. The first face 34 is the under-face, or under-surface, of the insole 12. The second face 36 is the upper face, or the upper surface, of the insole 12.

The first and second pads 18 and 26, the cover 30 and the shank support 32 are provided on the first face 34 of the insole 12.

The insole 12 is a single piece of material.

The insole 12 may be made of non-woven textile material or fibreboard.

FIGS. 6–9 show an embodiment of an item of footwear 100, in the form of a shoe, incorporating a cushioning device 10. The item of footwear 100 comprises a footwear upper 102, a cushioning device 10, and an outsole 106 attached to the footwear upper 102. An innersock 103 is provided inside the item of footwear 100 and overlies the insole 12. The use of such an innersock 103 is known in the art.

The footwear upper 102 is provided with a lasting margin 104. The lasting margin 104 substantially surrounds the periphery of the cushioning device 10 and is attached to the cushioning device 10.

The first and second pads 18 and 26 of the cushioning device 10 and the shank support 32 are provided on the first face 34 of the insole 12 such that the outsole 106 covers the first and second pads 18 and 26, the shank support 32 and the first face 34 of the insole 12.

Thus, the first and second pads 18 and 26, the cover 30 and the shank support 32 are provided on the underside of the insole 12 when the cushioning device 10 is incorporated into an item of footwear 100. Accordingly, when incorporated in an item of footwear 100 it is the second face 36 of the insole 12 of the cushioning device 10 which faces a wearer's foot.

Figure 6:
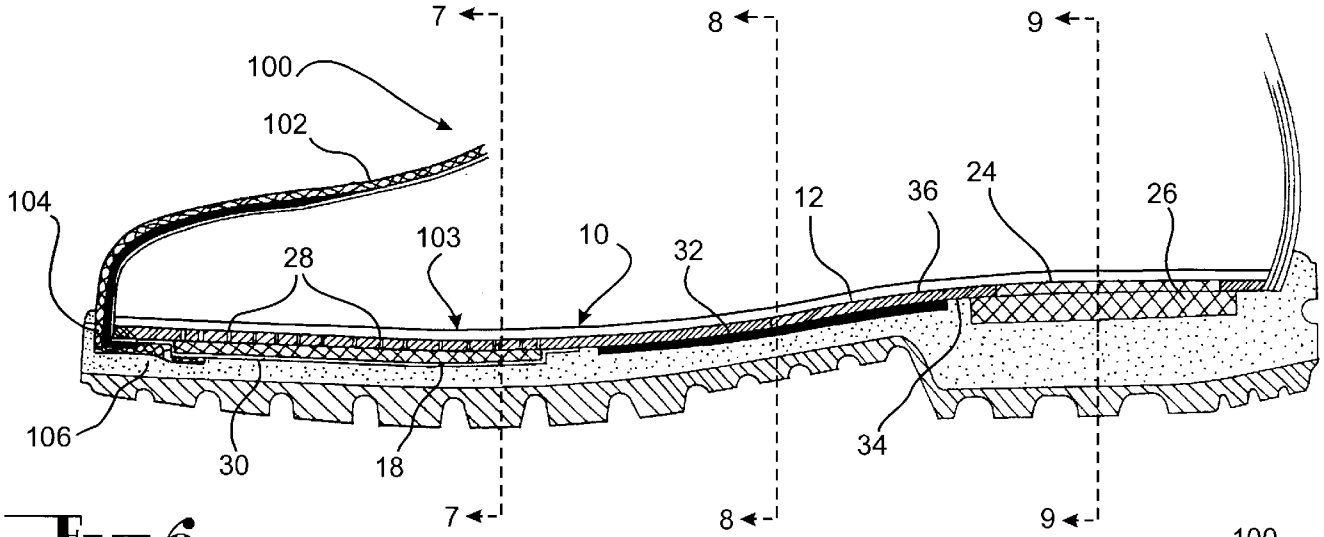
FIG. 6 is a cross-sectional view of an embodiment of an item of footwear in accordance with a second aspect of the present invention incorporating an embodiment of a cushioning device in accordance with the first aspect of the present invention.
Figure 9:
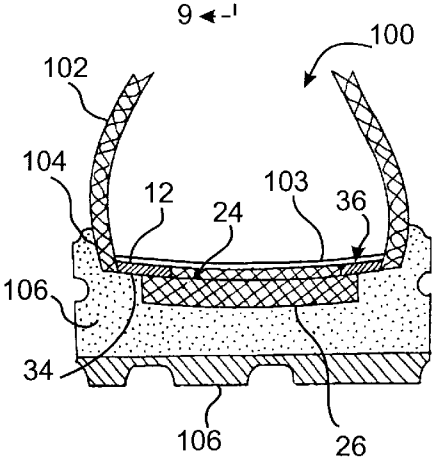
FIG. 9 is a cross-sectional view taken along the lines 9—9 shown in FIG. 6.
Figure 8:
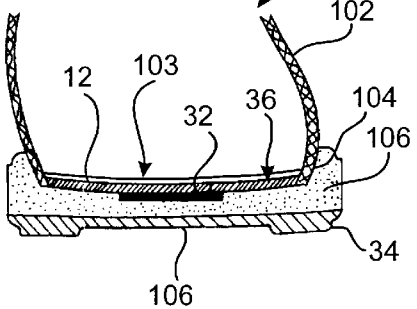
FIG. 8 is a cross-sectional view taken along the lines 8—8 shown in FIG. 6.
Figure 7:
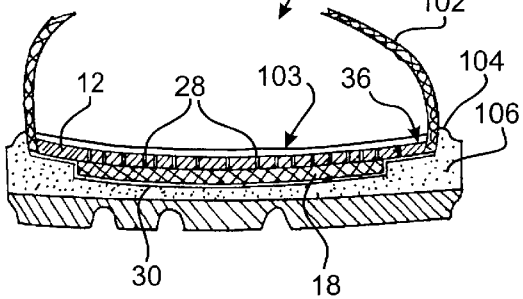
FIG. 7 is a cross-sectional view taken along the lines 7—7 shown in FIG. 6.

The first and second pads 18 and 26, the cover 30 and the shank support 32 are embedded in the outsole 106 as shown in FIG. 6.

A method of making a cushioning device for footwear in accordance with the present invention will now be described.

Insoles 12 may be cut from insole material. The insoles 12 are cut to the required shoe size for a left and right shoe as required.

Markings may then be placed on the insole 12 to indicate the portion to be cut out from the heel region 22 of the insole 12, the location of the region 14 at the forepart 16 of the insole 12 and the location of the shank support 32 at the mid region 33 of the insole 12.

The region 14 at the forepart 16 of the insole 12 is perforated in the required pattern to substantially coincide with the first to fifth metatarsal heads and big toe of a person's foot.

The region 14 at the forepart 16 of the insole 12 is then underlayed with the first pad 18 on the first face 34 of the insole 12. The first pad 18 may be adhered to the insole 12, for example, with a pressure sensitive adhesive.

The cover 30 is then attached to the forepart 16 to encapsulate the first pad 18. The cover 30 may be attached using a suitable adhesive, e.g. a hot-melt adhesive.

An opening 20 is cut out from the insole 12 at the heel region 22. The insert 24 is then positioned in the opening 22.

The second pad 26 is positioned to underlie the insert 24 on the first face 34 of the insole 12. The second pad 26 is attached to the insert 24 and the surrounding portion of the insole 12 by a suitable adhesive, e.g. a hot-melt adhesive.

A shank support 32 may be attached to the insole 12. The shank support 12 is attached on the first face 34 of the insole 12. Again, a suitable adhesive or other means of attachment may be used.

Having completed manufacture of the cushioning device 10 as hereinabove described, the cushioning device 10 may then be used in the manufacture of an item of footwear 100.

An item of footwear 100 may be made by providing a footwear upper 102. The footwear upper 102 is positioned over the cushioning device 10.

The second face 36 of the insole 12 is provided to face the interior of the item of footwear 100.

The footwear upper 102 has a lasting margin 104 which surrounds the periphery of the cushioning device 10.

An outsole 106 is then attached to the footwear upper 102, the cushioning device 10 and the lasting margin 104 such that the outsole 106 covers the first and second pads 18 and 26, the cover 30, 'shank support 32 and the first face 34 of the insole 12.

A material, e.g. polyurethane, may be injected and bonded to the lasting margin 104 of the footwear upper 102 and the cushioning device 10 to form the outsole 106 as can be seen in FIGS. 6–9. The surface of the second pad 26 may be scoured to enhance the bonding of the outsole material thereto.

The first and second pads 18 and 26, the cover 30 and the shank support 32 are embedded in the outsole 106 of the footwear 100.

The innersock 103 may be loose and simply inserted into the item of footwear 100 to overlie the second face 36 of the insole 12. Alternatively, the innersock 103 may be adhered to the second face 36 of the insole 12 prior positioning the footwear upper 102 over the cushioning device 10.

The outsole 106 may be attached to the footwear upper 102, the cushioning device 10 and the lasting margin 104 in a manner similar to the attachment of an outsole to the insole and lasting margin in known footwear.

The cushioning device 10 of the present invention when incorporated in footwear 100 provides energy absorption to the wearer which reduces the risk of injury caused by high and peak pressures acting on the foot due to impact shock and stress forces. The cushioning device 10 provides energy absorption to the areas of the foot which are most susceptible to high and peak pressures due to impact shock and stress forces. These areas of the foot are at the heel region and forepart of the foot.

Shock and energy absorption refer to the ability to absorb compression loads and impact forces.

The provision of an insert 24 in the cutout opening 20 and the underlying second pad 26 enables transfer of impact energy from the foot to the energy absorbing material of the insert 24 and the second pad 26. The region 14 at the forepart 16 of the insole 12 allows the insole 12 to contour to the shape of the first to fifth metatarsal heads and the large toe and also enables transfer of impact energy, or impact force, from the foot to the first pad 18. In particular, providing the region 14 by way of perforations 28 gives flexibility to the region 14 of the insole 12 and is responsive in transferring impact energy, or impact force, from the area of contact, of the outsole 106 with the ground, to the first pad 18. In addition, the perforations 28 reduce the rigidity of the region 14 of the insole 12 and enable the region 14 to conform to the compression which is imparted by the wearer's foot to the insole 12. The perforations 28 provide flexibility at the region 14 but enable the region 14 of the insole 12 to still provide support under the first to fifth metatarsal heads and the big toe of a wearer's foot which is important for enabling the foot to maintain balance.

Footwear 100 incorporating a cushioning device 10 also provides improved flexibility and comfort to the wearer.

Footwear 100 incorporating the cushioning device 10 of the present invention, having an insert 24 in the heel region 22 and first and second pads 18 and 26 on the under-face of the insole 12, embedded in the outsole 106, provides shock absorption from impact from both directions. That is, firstly, it provides shock absorption from impact caused by the wearer's foot—this is impact in the downward direction. Secondly, it provides shock absorption from impacts with the outsole 106, e.g. when the outsole 106 contacts irregularities in the surface upon which the wearer is walking,—these impacts are in the upward direction.

Modifications and variations such as would be apparent to a skilled addressee are deemed to be within the scope of the present invention.

Throughout the specification, unless the context requires otherwise, the word "comprise" or variations such as "comprises" or "comprises", will be understood to imply the inclusion of a stated integer or group of integers but not the exclusion of any other integer or group of integers.

What is claimed is:

1. Cushioning device for footwear comprising an insole;

a region at the forepart of said insole having perforations such that said region at the forepart of said insole has greater flexibility than the remainder of said insole to enable said region at the forepart of said insole to conform in response to compression imparted to said insole;

first pad means on the under-face of said insole underlying said region at the forepart of said insole, said first pad is of substantially the same shape and size as said region at the forepart of said insole;

a cutout opening in the heel region of said insole;

an insert provided in said cutout opening;

second pad on the under-face of said insole underlying said insert and said first and second pad and said insert being substantially shock absorbing and resilient.

2. Cushioning device according to claim 1, wherein said region at the forepart of said insole substantially coincides with the first to fifth metatarsal heads and big toe of a person's foot.

3. Cushioning device according to claim 1, wherein a cover is provided over said first pad on the under-face of said insole at said forepart of said insole.

4. Cushioning device according to claim 1, wherein said first pad is attached to said insole.

5. Cushioning device according to claim 1, wherein said second pad is attached to said insole and said insert.

6. Cushioning device according to claim 1, wherein a shank support is provided at substantially the mid region of said insole intermediate said forepart and said heel region thereof.

7. Cushioning device according to claim 6, wherein said shank support does not overlap with said first or second pad.

8. Cushioning device according to claim 6, wherein said shank support is substantially in the form of a strip of supportive material having greater rigidity than said insole.

9. Cushioning device according to claim 6, wherein said shank support is provided on said under-face of said insole.

10. Cushioning device according to claim 1, wherein said perforations at said region at the forepart of said insole have a diameter substantially in the range of 1 mm–2 mm.

11. Cushioning device according to claim 1, wherein said second pad is larger than said insert such that said second pad covers said insert and overlaps onto the surrounding portion of said insole.

12. Cushioning device according to claim 1, wherein said insole is a single piece of material.

13. Cushioning device according to claim 1, wherein said insole is made of non-woven textile material or fibreboard.

14. An item of footwear comprising a footwear upper, a cushioning device according to claim 1, and an outsole attached to said footwear upper, wherein said outsole covers said first and second pads and said under-face of said insole.

15. An item of footwear according to claim 14, wherein said footwear upper is provided with a lasting margin which substantially surrounds the periphery of said cushioning device and is attached to said cushioning device.

16. A method of making an item of footwear comprising providing a footwear upper, providing a cushioning device according to claim 1, covering said first and second pad and said under-face of said insole with an outsole, and attaching said outsole to said footwear upper.

17. A method of making a cushioning device for footwear comprising;

providing an insole;

perforating a region at the forepart of said insole such that said region at the forepart of said insole has greater flexibility than the remainder of said insole to enable said region at the forepart of said insole to conform in response to compression imparted to said insole;

underlying said region at the forepart of said insole with a first pad on the under-face of said insole, said first pad being substantially the same shape and size as said region at the forepart of said insole;

cutting out an opening in the heel region of said insole;

positioning an insert in said opening;

underlying said insert with a second pad on the under-face of said insole; and said first and second pad and said insert being substantially shock absorbing and resilient.

18. A method according to claim 17, wherein it further comprises providing said region at the forepart of said insole to substantially coincide with the first to fifth metatarsal heads and big toe of a person's foot.

19. A method according to claim 17, wherein it further comprises covering said first pad at the forepart of said insole on the under-face of said insole.

20. A method according to claim 17, wherein it further comprises attaching said first pad to said insole.

21. A method according to claim 17, wherein it further comprises attaching said second pad to said insole and said insert.

22. A method according to claim 17, wherein it further comprises providing a shank support substantially at the mid region of said insole intermediate said forepart and said heel region thereof.

23. A method according to claim 22, wherein it further comprises providing said shank support on the under-face of said insole.

24. A method of making an item of footwear comprising providing a footwear upper, making a cushioning device according to claim 17, covering said first and second pad and said under-face of said insole with an outsole, and attaching said outsole to said footwear upper.

25. A method according to claim 24, wherein it further comprises attaching a lasting margin to said cushioning device, said footwear upper provided with said lasting margin which substantially surrounds the periphery of said cushioning device.

26. A method according to claim 24, wherein it further comprises overlying said insole with an innersock.

27. A method according to claim 16, wherein it further comprises attaching a lasting margin to said cushioning device, said footwear upper provided with said lasting margin which substantially surrounds the periphery of said cushioning device.

28. A method according to claim 16, wherein it further comprises overlying said insole with an innersock.

* * * * *

UNITED STATES PATENT AND TRADEMARK OFFICE

CERTIFICATE OF CORRECTION

PATENT NO. : 6,508,017 B1
DATED : January 21, 2003
INVENTOR(S) : Lee

It is certified that error appears in the above-identified patent and that said Letters Patent is hereby corrected as shown below:

Column 5,
Line 14, “cover 30, ‘shank support 32” should read -- cover 30, shank support 32 --.
Line 28, “prior positioning” should read -- prior to positioning --.

Column 6,
Line 16, ““comprises” or “comprises”,” should read -- “comprises” or “comprising”, --.

Signed and Sealed this

Fifteenth Day of June, 2004

JON W. DUDAS
*Acting Director of the United States Patent and Trademark Office*

UNITED STATES PATENT AND TRADEMARK OFFICE

CERTIFICATE OF CORRECTION

PATENT NO. : 6,508,017 B1
APPLICATION NO. : 09/763322
DATED : January 21, 2003
INVENTOR(S) : DeBarro et al.

It is certified that error appears in the above-identified patent and that said Letters Patent is hereby corrected as shown below:

Column 5, Line 14, “cover 30, ‘shank support 32” should read --cover 30, shank support 32--.

Column 5, Line 28, “prior positioning” should read --prior to positioning--.

Column 6, Line 16, ““comprises” or “comprises”,” should read --“comprises” or “comprising”,--.

Signed and Sealed this

First Day of May, 2007

JON W. DUDAS
*Director of the United States Patent and Trademark Office*